US007671816B2

(12) United States Patent
Jones et al.

(10) Patent No.: US 7,671,816 B2
(45) Date of Patent: Mar. 2, 2010

(54) LOW FREQUENCY ANTENNA

(75) Inventors: Rowland Jones, Carlsbad, CA (US); Jeffrey Shamblin, San Marcos, CA (US); Sebastian Rowson, San Diego, CA (US); Laurent Desclos, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 11/870,343

(22) Filed: Oct. 10, 2007

(65) Prior Publication Data

US 2009/0096693 A1 Apr. 16, 2009

(51) Int. Cl.
*H01Q 1/00* (2006.01)
*H01Q 9/16* (2006.01)
*H01Q 1/36* (2006.01)

(52) U.S. Cl. ..... 343/787; 343/793; 343/895

(58) Field of Classification Search ..... 343/787, 343/793, 873, 895, 872
See application file for complete search history.

(56) References Cited

U.S. PATENT DOCUMENTS

| | | | | |
|---|---|---|---|---|
| 5,014,071 | A * | 5/1991 | King | 343/788 |
| 5,900,845 | A * | 5/1999 | Mandai et al. | 343/895 |
| 7,046,200 | B2 * | 5/2006 | Furuya | 343/700 MS |
| 7,202,766 | B2 * | 4/2007 | Inuzuka | 336/83 |
| 2009/0051611 | A1 * | 2/2009 | Shamblin et al. | 343/747 |

* cited by examiner

*Primary Examiner*—Shih-Chao Chen
(74) *Attorney, Agent, or Firm*—Coastal Patent, LLC; Joshua S. Schoonover

(57) ABSTRACT

An antenna includes a core formed of a high-permeability material and a coil wire wrapped around at least a part of the core. In one embodiment, the high-permeability material includes ferrite material.

22 Claims, 5 Drawing Sheets

LOW FREQUENCY ANTENNA

BACKGROUND OF THE INVENTION

The present invention relates generally to the field of wireless communication. In particular, the present invention relates to an antenna for use within such wireless communication.

As handsets and other wireless communication devices become smaller and embedded with more applications, new antenna designs are required to address inherent limitations of these devices. Many such devices require coverage in low-frequency ranges, sometimes in addition to higher frequency communication ranges.

Conventional low-frequency antenna structures are formed by wrapping a coil around a ceramic bar. As the desired frequency or frequency range decreases, the size of the coil increases. Thus, for an antenna in the frequency range of approximately 100 MHz, the antenna requires a coil of approximately 1.4 meters. Such sizes can be inefficient and impractical for in many applications, such as for use with portable devices such as many wireless communication devices.

SUMMARY OF THE INVENTION

One aspect of the invention relates to an antenna which includes a core formed of a high-permeability material and a coil wire wrapped around at least a part of the core. In one embodiment, the high-permeability material includes ferrite material.

In one embodiment, the antenna further includes an electronic element connected to an end of the coil wire. The electronic element may be an inductive element or an active element.

In one embodiment, the core has a cylindrical configuration. The coil wire may be wrapped around a perimeter of the cylindrical configuration. Alternatively, the coil wire may be wrapped around a perimeter of the cylindrical configuration in a longitudinal direction of the cylindrical configuration. The coil wire may be wrapped around only a portion of the perimeter of the cylindrical configuration and may provide a vacant region of the core with no coil wire wrapped thereupon.

In one embodiment, the cylindrical configuration includes a hollow center. In another embodiment, the cylindrical configuration includes a center formed of a composite material. The composite material may support a conductive central axis passing through the center of the cylindrical configuration.

In one embodiment, the cylindrical configuration has a semi-circular cross section.

In one embodiment, the core has a non-cylindrical configuration. The non-cylindrical configuration may have a concave section which, in one embodiment, surrounds at least a portion of a printed circuit board.

In one embodiment, the core is positioned relative to a printed circuit board. A path of the coil wire may be elongated through the printed circuit board.

In one embodiment, the core is positioned within a volume of material. At least one antenna element may be formed on the volume of material. The antenna element may be an isolated magnetic dipole antenna element.

In another aspect, the invention relates to a communication device. The communication device includes a printed circuit board and an antenna. The antenna includes a core formed of a high-permeability material and a coil wire wrapped around at least a part of the core.

DETAILED DESCRIPTION OF THE PREFERRED EMBODIMENTS

Figure 1A:
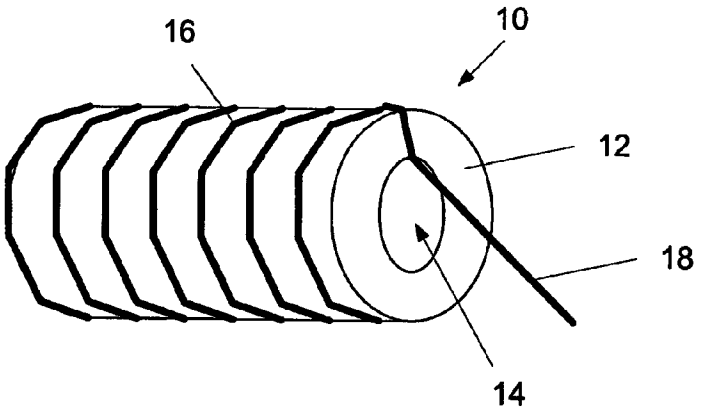
FIG. 1A is a perspective illustration of a low-frequency antenna according to an embodiment of the present invention.

Rather than forming an antenna by wrapping a coil around a ceramic core, embodiments of the present invention reduce the size of such antennas by modifying certain material properties of the core. Specifically, in accordance with embodiments of the present invention, the permeability of the core is varied to achieve the desired result. By changing the permeability of the core, antenna parameters such as bandwidth and efficiency can be optimized or improved as the overall size is reduced.

The electromagnetic properties of materials, such as permeability and permittivity, can be understood by examination of propagation of waves. The wavelength of a wave propagating in through a material may change compared to free space propagation. In free space, the wavelength and frequency of a wave are related by:

$$c=f\lambda \tag{1}$$

where:

c=speed of light (meters/second), f=frequency in Hertz (1/second), and $\lambda$=wavelength (meters).

The following equation (derived directly from Maxwell's equations) relates the speed of light to the permittivity and permeability of free space:

$$c=1/(\epsilon_0\mu_0)^{1/2} \tag{2}$$

where: $\epsilon_0$=permittivity of free space=$8.8542\times10^{-12}$ Farad/meter, and $\mu_0$=permeability of free space=$4\pi\times10^{-7}$ Henry/meter.

From the units associated with the permittivity (Farads per meter), it can be noted that the permittivity describes the effect the material will have on the electric field component of the electromagnetic wave. With units of Henrys per meter, the permeability relates to the magnetic properties of the material. In electromagnetics, where there are traveling waves, the permittivity (partially defined by the dielectric constant of the material) and the permeability quantify the ability of a material to store electric and magnetic energy, respectively.

The wavelength can be related to permittivity and permeability by combining equations (1) and (2) above:

$$f\lambda=1/(\epsilon_0\mu_0)^{1/2} \quad (3)$$

$$\lambda=1/(f(\epsilon_0\mu_0)^{1/2}). \quad (4)$$

The permeability of a material can be expressed as a relative permeability:

$$\mu_r=\mu'/\mu_0 \quad (5)$$

where: $\mu_r$=relative permeability, and $\mu'$=permeability of a material.

High-permeability materials, such as ferrites, have a permittivity equal to that of free space. Therefore, the relative permittivity of such materials is: $\epsilon_r$=1.0. For such materials, the wavelength in the material can be expressed as:

$$\lambda_m=1/(f(\epsilon'\mu')^{1/2})=1/(f(\epsilon_o\mu')^{1/2}). \quad (6)$$

The change in wavelength of a wave in a volume of material compared to that in free space can be determined as:

$$\lambda_m=\lambda/\sqrt{\mu_r} \quad (7)$$

Thus, the wavelength of an electromagnetic wave traveling in a volume of material with a relative permeability of $\mu_r$ can be determined.

In using such materials for antenna applications, a material may be selected to achieve the desired result for the specific frequency range of the antenna. Magnetic materials (ferrites) may be used for the low frequency applications (e.g., below 200 MHz). For low-frequency antennas, increased permeability of a ferrite material can assist in reducing the frequency of operation of a wire antenna.

Referring now to FIG. 1A, an antenna 10 according to an embodiment of the present invention is illustrated. The antenna includes a core 12 of material. In accordance with embodiments, the core 12 is formed of a high-permeability material, such as ferrite material. In the illustrated embodiments, the core has a hollow center 14. In other embodiments, as described below with reference to FIG. 7, the center may be formed of a different material.

Figure 4:
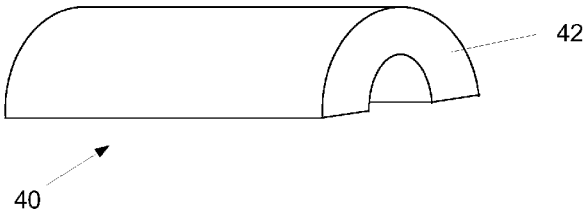
FIG. 4 is a perspective illustration of a core for a low-frequency antenna according to another embodiment of the present invention.

Further, the core 12 of FIG. 1A is illustrated as having a cylindrical configuration with a circular cross section. In other embodiments, the core 12 may have a variety of other configurations. For example, FIG. 4 illustrates a core 42 of an antenna 40 with a cylindrical configuration. However, the cylindrical configuration of FIG. 4 has a semi-circular cross section. Additional configurations, such as non-cylindrical configurations, are described below with reference to FIGS. 5 and 6, for example. Those skilled in the art will understand that numerous other cylindrical and non-cylindrical configurations are possible and are contemplated within the scope of the present invention.

Referring again to FIG. 1A, a coil wire 16 is wrapped around the core 12. The coil wire 16 may be formed of any of a variety of materials. Such materials are well known to those skilled in the art. The coil wire 16 may have an end 18 extending from the core 12. As described below with reference to FIG. 2, the end 18 may be used to couple the antenna to other elements.

Figure 1B:
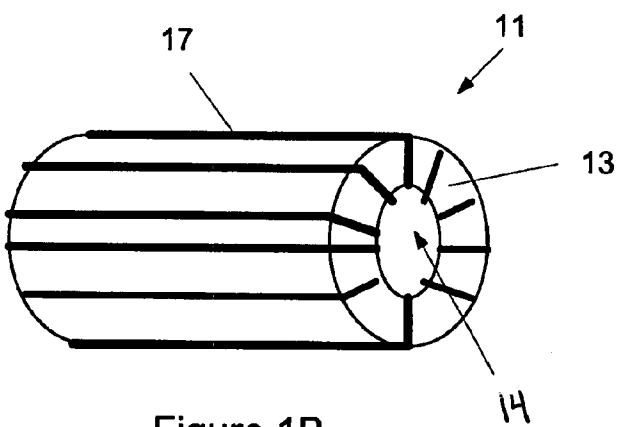
FIG. 1B is a perspective illustration of a low-frequency antenna according to another embodiment of the present invention.
Figure 3:
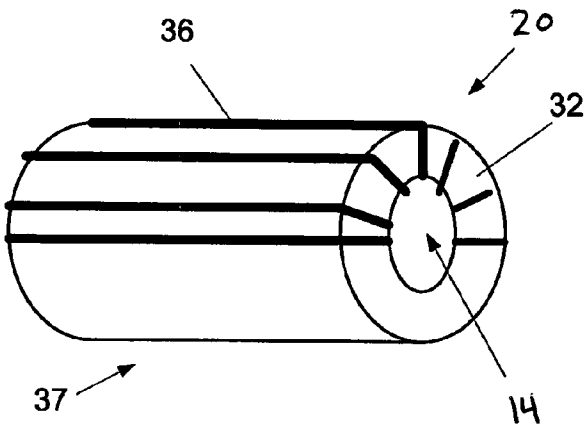
FIG. 3 is a perspective illustration of a low-frequency antenna according to another embodiment of the present invention.

While FIG. 1A illustrates the coil wire 16 wrapped around the perimeter of the core 12, other embodiments may provide different configuration for the wrapping of the coil wire. For example, as illustrated in FIG. 1B, the coil wire 17 may be wrapped around a perimeter of the cylindrical configuration of a core 13 in a longitudinal direction. Further, if the antenna 11 is to be positioned near a board and interference between the board and the coil wire may result, the coil wire may be wrapped around only a portion of the perimeter of the cylindrical configuration. For example, as illustrated in FIG. 3, the coil wire 36 is wrapped only around the top portion of the core 32. Thus, a vacant region of the core is provided with no coil wire wrapped thereupon. The vacant region may be placed closest to the board to minimize or eliminate interference.

Figure 2:
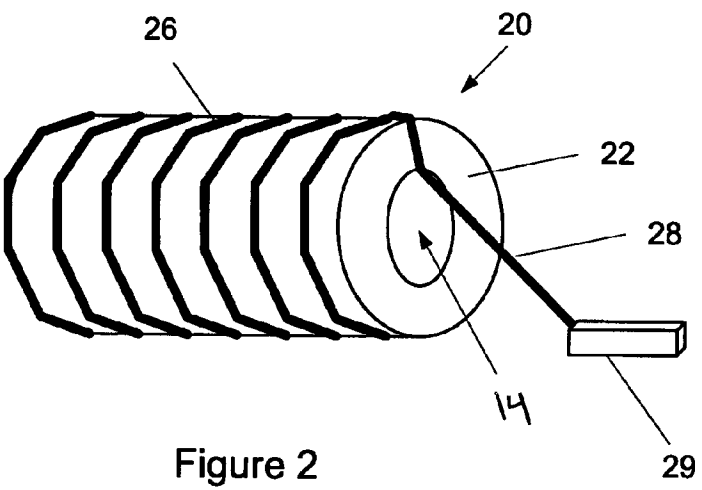
FIG. 2 is a perspective illustration of a low-frequency antenna according to another embodiment of the present invention.

In some embodiments, as illustrated in FIG. 2, the low-frequency antenna 20 further includes an electronic element 29 connected to an end 28 of the coil wire 26 wrapped around a core 22. The electronic element 29 may be an inductive element or an active element, such as a switch or other such element. The placement of the electronic element 29 may facilitate additional length of filtering effects for the antenna 20.

Figure 5:
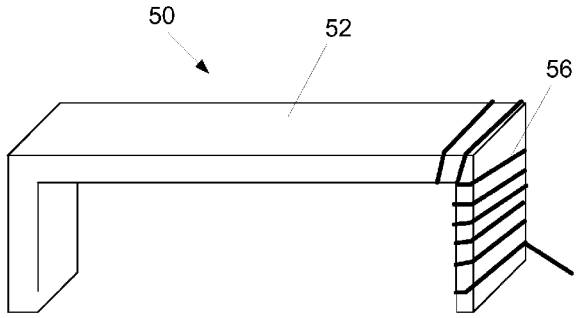
FIG. 5 is a perspective illustration of a low-frequency antenna according to another embodiment of the present invention.

Referring now to FIG. 5, an antenna 50 having a core 52 with a non-cylindrical configuration is illustrated. The antenna 50 illustrated in FIG. 5 includes a core 52 formed of a high-permeability material. The core 52 of the embodiment of FIG. 5 is configured as a bar with three perpendicular segments forming a concave section thereunder. A coil wire 56 is wrapped around the at least a portion of the core 52. The length of the coil wire 56 may be adapted to achieve the desired frequency.

Figure 6:
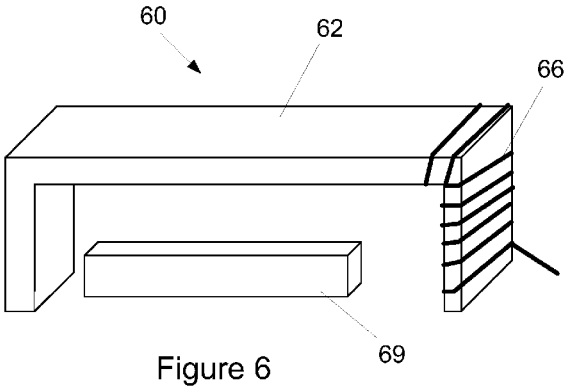
FIG. 6 is a perspective illustration of a low-frequency antenna according to another embodiment of the present invention.

An antenna such as the one illustrated in FIG. 5 may be adapted to accommodate components in the concave section. Thus, the concave section may surround a component or at least a portion of a printed circuit board, for example. For example, as illustrated in FIG. 6, an antenna 60 with a non-cylindrical core 62 may be coupled with an electronic component 69, such as chip set, positioned in the concave section.

Of course, certain cylindrical configurations may also include a concave section adapted to accommodate such electronic components. For example, the antenna 40 illustrated in FIG. 4 has a core with a cylindrical configuration with a semi-circular cross section. The semi-circular cross section forms a concave section in which an electronic component may be accommodated.

Figure 7:
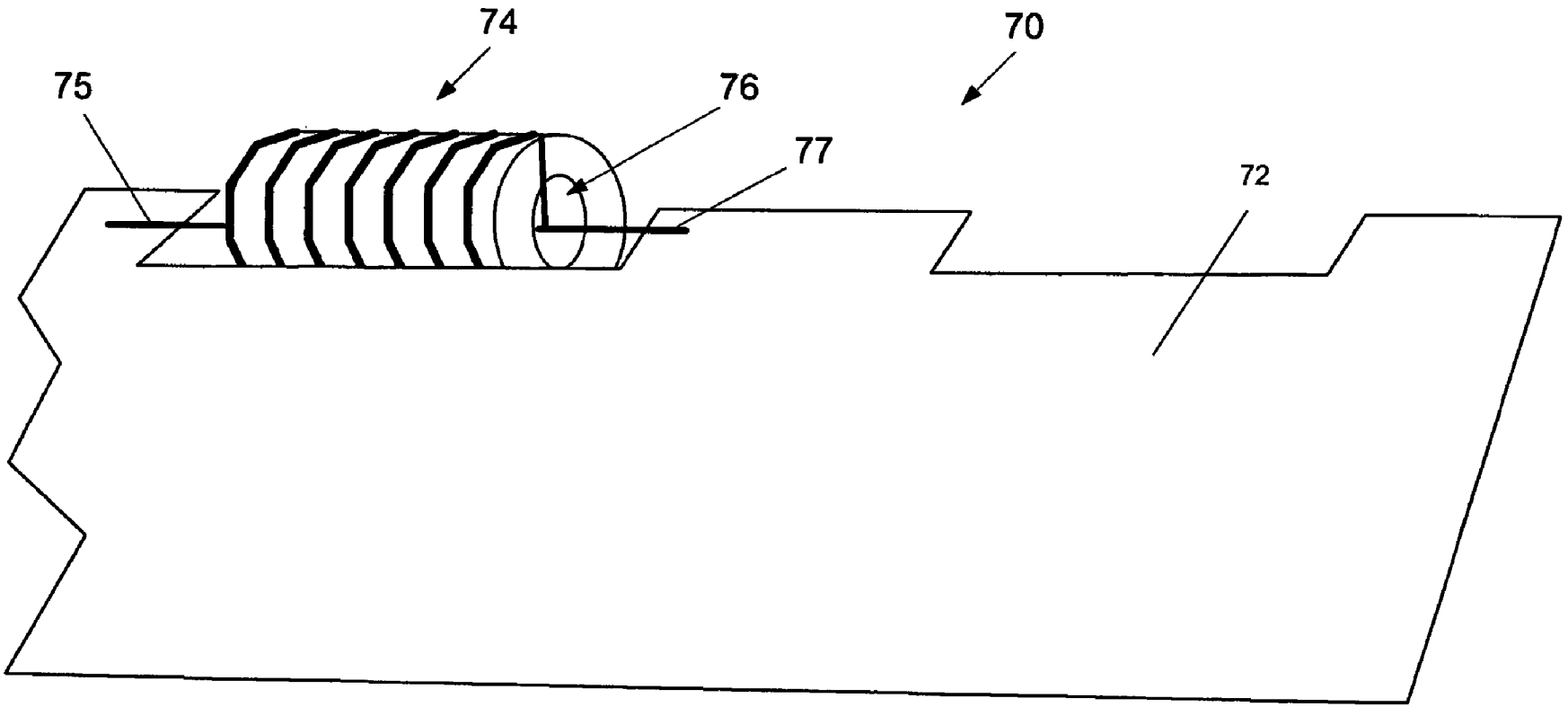
FIG. 7 is a perspective illustration of an arrangement with a low-frequency antenna according to an embodiment of the present invention.

Referring now to FIG. 7, an antenna arrangement according to an embodiment of the present invention is illustrated. In this embodiment, the antenna arrangement 70 includes a low-frequency antenna 74 positioned relative to a board 72, such as a printed circuit board. The board 72 and the antenna 74 may form at least a portion of a communication device. For example, the antenna 74 may be embedded within the board 72. The antenna 74 includes a conductive central axis having leads 75, 77 on each end of the core of the antenna 74. The conductive central axis leads 75, 77 are supported by a material in the center 76 of the coil. While certain embodiments may include a core with a hollow center, the center 76 of the embodiment of FIG. 7 is formed of a composite material to support the conductive central axis leads 75, 77 and secure them along the central axis.

Figure 8:
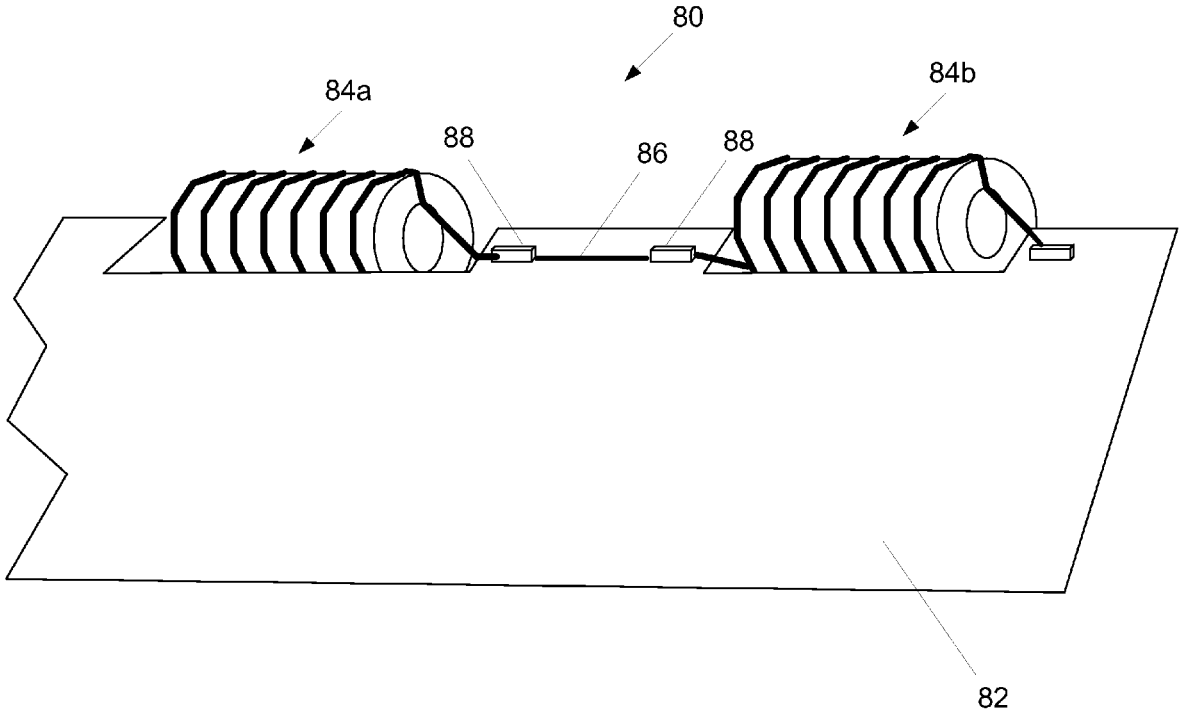
FIG. 8 is a perspective illustration of another arrangement with a low-frequency antenna according to an embodiment of the present invention.

Referring now to FIG. 8, an antenna arrangement 80 according to another embodiment of the present invention is illustrated. The antenna arrangement includes multiple low-frequency antennas or antenna elements 84*a*, 84*b* positioned relative to a printed circuit board 82. The antenna elements 84*a*, 84*b* are connected through lines 86 on the printed circuit board 82. Thus, the antenna path may be elongated, and the antenna elements 84*a*, 84*b* may be positioned where space is available on the printed circuit board 82. Additionally, other electronic components 88 may be positioned on the printed circuit board 82. As noted above with regard to FIG. 2, the electronic components 88 may be active components such as switches.

Figure 9:
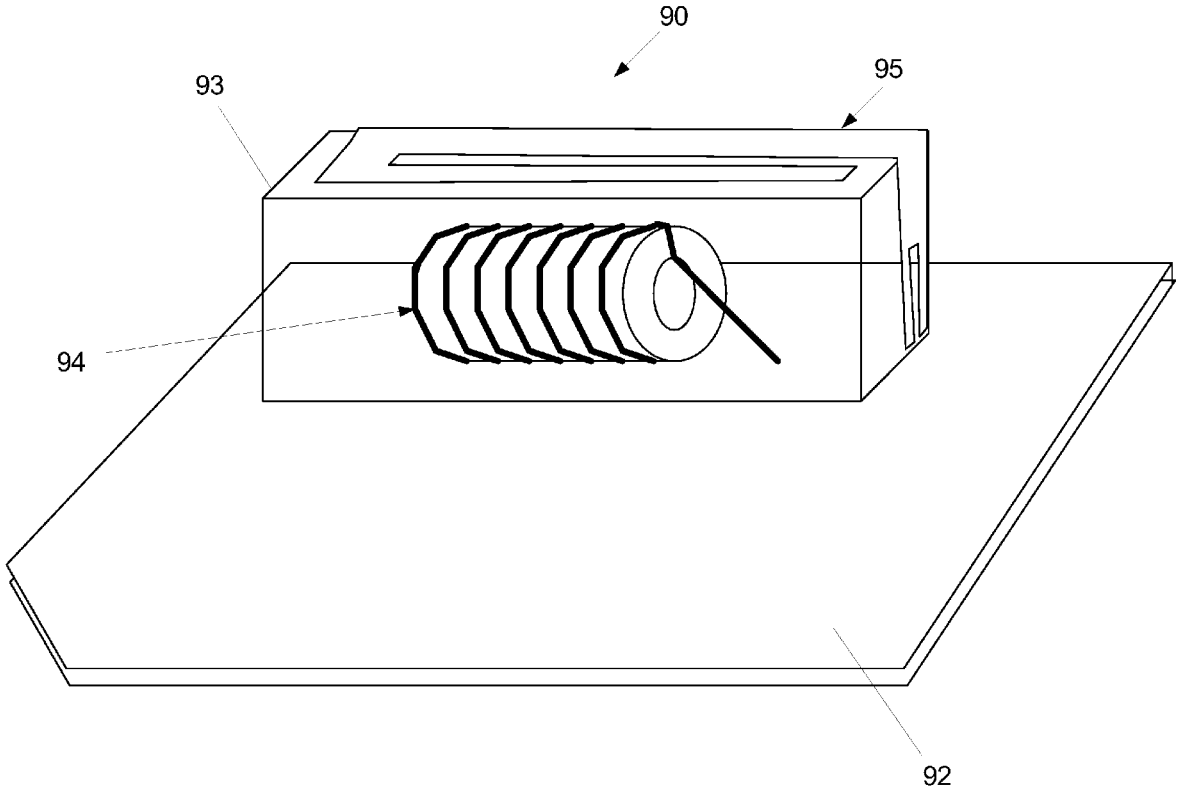
FIG. 9 is a perspective illustration of another arrangement with a low-frequency antenna according to an embodiment of the present invention.

Referring now to FIG. 9, in one embodiment of an antenna arrangement 90, a low-frequency antenna 94 may be coupled with another antenna element 95 to provide additional bandwidth or multi-frequency capability for a communication device. In the embodiment illustrated in FIG. 9, the low-frequency antenna 94 with a core wrapped with a coil wire is positioned within a volume of material 93. At least one antenna element 95 may be formed on the volume of material 93. In the illustrated embodiment, the antenna element 93 is an isolated magnetic dipole (IMD) antenna element. The material used in the volume of material 93 may be selected to provide the desired characteristics for the IMD antenna element 95. In one embodiment, the volume of material 93 includes a dielectric material. The use of dielectric or ferrite materials in a volume of material is described in greater detail in U.S. patent application Ser. No. 11/840,861, filed Aug. 17, 2007, titled ANTENNA WITH VOLUME OF MATERIAL, which is hereby incorporated by reference in its entirety. The antenna arrangement 90 may be integrated with a communication device by mounting the volume of material 93 and/or the low-frequency antenna 94 on a printed circuit board 92, along with appropriate electrical connections.

Thus, a low frequency antenna and antenna arrangements incorporating such antennas can be provided with a reduced size.

The foregoing description of embodiments of the present invention have been presented for purposes of illustration and description. It is not intended to be exhaustive or to limit the present invention to the precise form disclosed, and modifications and variations are possible in light of the above teachings or may be acquired from practice of the present invention. The embodiments were chosen and described in order to explain the principles of the present invention and its practical application to enable one skilled in the art to utilize the present invention in various embodiments and with various modifications as are suited to the particular use contemplated.

What is claimed is:

1. An antenna, comprising:

a core formed of a high-permeability material, a coil wire wrapped around at least a part of the core; and, an electronic element connected to an end of the coil wire, wherein said electronic element is one of: an inductive element, or an active element, and wherein said electronic element facilitates additional length for the antenna.

2. The antenna of claim 1, wherein the high-permeability material includes ferrite material.

3. The antenna of claim 1, wherein the core has a cylindrical configuration.

4. The antenna of claim 3, wherein the coil wire is wrapped around a perimeter of the cylindrical configuration.

5. The antenna of claim 3, wherein the cylindrical configuration includes a hollow center.

6. The antenna of claim 3, wherein the cylindrical configuration includes a center formed of a composite material.

7. The antenna of claim 6, wherein the composite material supports a conductive central axis passing through the center of the cylindrical configuration.

8. The antenna of claim 3, wherein the coil wire is wrapped around a perimeter of the cylindrical configuration in a longitudinal direction of the cylindrical configuration.

9. The antenna of claim 8, wherein the coil wire is wrapped around only a portion of the perimeter of the cylindrical configuration and providing a vacant region of the core with no coil wire wrapped thereupon.

10. The antenna of claim 3, wherein the cylindrical configuration has a semi-circular cross section.

11. The antenna of claim 1, wherein the core has a non-cylindrical configuration.

12. The antenna of claim 11, wherein the non-cylindrical configuration has a concave section.

13. The antenna of claim 12, wherein the concave sections surrounds at least a portion of a printed circuit board.

14. The antenna of claim 1, wherein the core is positioned relative to a printed circuit board.

15. The antenna of claim 14, a path of the coil wire is elongated through the printed circuit board.

16. The antenna of claim 1, wherein the core is positioned within a volume of material.

17. The antenna of claim 16, wherein at least one antenna element is formed on the volume of material.

18. The antenna of claim 17, wherein the antenna element is an isolated magnetic dipole antenna element.

19. A communication device, comprising:

a printed circuit board; and an antenna, the antenna comprising:

a core formed of a high-permeability material, a coil wire wrapped around at least a part of the core; and, an electronic element connected to an end of the coil wire, wherein said electronic element is one of: an inductive element or an active element, and wherein said electronic element facilitates additional length for the antenna.

20. The communication device of claim 19, wherein the high-permeability material includes ferrite material.

21. An antenna, comprising:

a first antenna element, and a second antenna element;

said first antenna element comprising a core formed of a high-permeability material, and a coil wire wrapped around at least a part of the core, said first antenna element positioned within a volume of material, said second antenna element comprising an Isolated Magnetic Dipole element and positioned on the volume of material, wherein said first antenna element is a low frequency antenna element and is coupled to said second antenna element for providing at least one of:

additional bandwidth or multifrequency operation.

22. The antenna of claim 21, wherein the volume of material is a dielectric material.

* * * * *